US006048233A

United States Patent [19]

Cole

[11] Patent Number: 6,048,233

[45] Date of Patent: Apr. 11, 2000

[54] RETROFIT ARRANGEMENT FOR ATTACHING LEADS TO COMPRESSOR MOTOR TERMINALS

[75] Inventor: Gregory S. Cole, Ormond Beach, Fla.

[73] Assignee: Mainstream Engineering Corp., Rockledge, Fla.

[21] Appl. No.: 09/075,211

[22] Filed: May 11, 1998

[51] Int. Cl.[7] ..... H01R 4/50

[52] U.S. Cl. ..... 439/807

[58] Field of Search ..... 439/801, 807, 439/815, 792, 888, 863, 756, 100

[56] References Cited

U.S. PATENT DOCUMENTS

| | | | |
|---|---|---|---|
| 2,107,835 | 2/1938 | Pierce | 439/100 |
| 2,233,216 | 2/1941 | Matthysse | 439/807 |
| 3,447,122 | 5/1969 | Beck | 439/807 |
| 3,803,534 | 4/1974 | Debaigt | 439/807 |
| 4,600,264 | 7/1986 | Counsel | 439/807 |
| 4,619,497 | 10/1986 | Vogel | 439/807 |
| 5,632,633 | 5/1997 | Roosdorp | 439/100 |

FOREIGN PATENT DOCUMENTS

| | | | |
|---|---|---|---|
| 2315175 | 1/1977 | France | 439/756 |

*Primary Examiner*—Renee S. Luebke
*Assistant Examiner*—Javaid Nasri
*Attorney, Agent, or Firm*—Evenson, McKeown, Edwards & Lenahan P.L.L.C.

[57] ABSTRACT

A retrofit arrangement is used to attach leads to deteriorated compressor terminals and the like. A secure holding force between the leads and the terminals is obtained with a wedging force. A screw arranged at an angle to the terminal can directly provide the wedging force or, alternatively, indirectly through one or more wedge-shaped bodies.

20 Claims, 4 Drawing Sheets

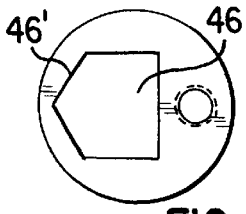
FIG. 3b'
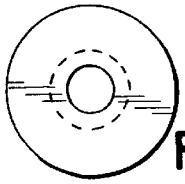
FIG. 3c'
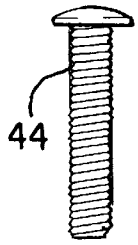
FIG. 3d
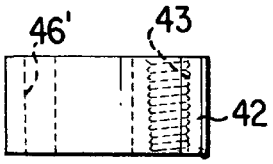
FIG. 3b
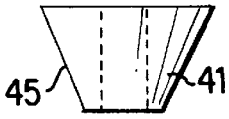
FIG. 3c
FIG. 3a'
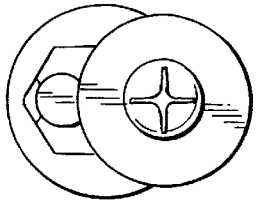
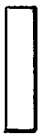
FIG. 4b'
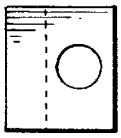
FIG. 4c'
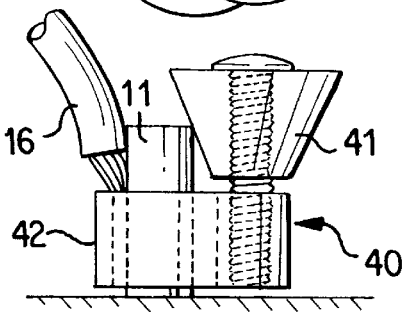
FIG. 3a
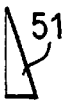
FIG. 4b
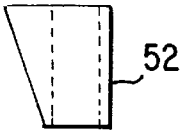
FIG. 4c
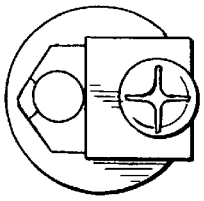
FIG. 4a'
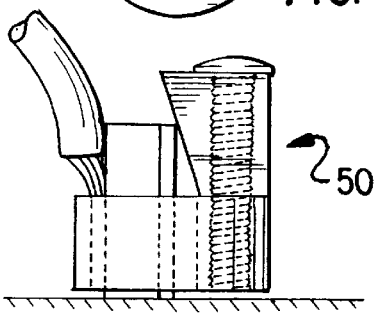
FIG. 4a

RETROFIT ARRANGEMENT FOR ATTACHING LEADS TO COMPRESSOR MOTOR TERMINALS

BACKGROUND AND SUMMARY OF THE INVENTION

The present invention relates to a body for use with compressor motor terminals, and more particularly, to an arrangement which uses wedging for effectively and securely retrofitting an electrical lead on a deteriorated compressor terminal.

A conventional hermetically sealed electric motor 10 used for air conditioning compressors and the like typically has three identical terminals 11, 12, 13 arranged in a triangular pattern as seen in FIG. 1*a* and substantially encapsulated in an electrically insulating plug. These types of terminals protrude about ⅜" from the insulating plug and typically consist of a ¼"x1/32" spade welded or brazed to a ⅛" diameter cylindrical pin that passes through the insulating plug. The specific configuration of a known individual terminal, e.g. terminal 11, is shown in FIG. 1*b* and includes the terminal body and the welded-on spade 15.

Electrical power is typically supplied to the compressor motor 10 by lead wires with female connections attached to the end that fit over the above-described male-type spade terminals 11, 12, 13. This connection often has poor mechanical contact (thus also poor electrical contact) and causes the terminal to deteriorate through arcing and the like. Part or all of the spade-type connector or terminal (FIG. 1*b*) may be deteriorated to a point where the original female connector can no longer serve its intended purpose. A new adapter is needed that can easily replace the old connection and can be attached to a partially deteriorated terminal without removing the deteriorated terminal because removal of the terminal can damage the hermetic seal due to the fragility of the insulator plug.

Conventional approaches for allowing an electrical lead to be connected to a deteriorated terminal have a number of disadvantages. For example, they do not work well in confined spaces or else require the use of special tooling.

U.S. Pat. No. 5,662,502, for example, describes an adapter designed to enable an electrical connection to damaged or deteriorated male connectors on a compressor assembly. In particular, a set screw is provided at the bottom of a tube so as to engage the damaged rod or cylindrical pin of the terminal. One problem with this approach is that the set screw connection can be loosened due to vibrations and the like and/or the thread can become stripped because the walls of the tube must be made thin due to terminal spacing restraints and can contain only a few threads. That is, a high drive torque is created by the set screw connection which causes failure of the few threads which are too few and too fine to withstand the torque.

An object of the present invention is to provide an arrangement which is simple in construction and permits a secure connection to a compressor terminal.

Another object of the present invention is to provide a connector which can be used in confined spaces and with standard tooling.

A yet further object of the present invention is to provide an arrangement which allows manipulation to attach the lead by access to the front face of the connector rather than the side which has more obstructions present so as to limit convenient accessibility.

Still another object of the present invention is to provide a connector which achieves improved electrical contact with the terminal and thereby reduces electrical resistance.

Yet a further object of the present invention is to employ an adapter which can be constructed from readily available, inexpensive conductive and non-conductive materials.

A still additional object of the present invention is to allow a connector to be securely connected with the terminal without the need to remove any portion of the deteriorated terminal.

This object has been achieved in accordance with the present invention by providing a connector body which utilizes a wedging force or action to securely fasten an electrical lead to a deteriorated compressor terminal.

BRIEF DESCRIPTION OF THE DRAWINGS

Other objects, advantages and novel features of the present invention will become apparent from the following detailed description of the invention when considered in conjunction with the accompanying drawings wherein:

FIGS. 3*a* and 3*a*' are, respectively, elevational and plan views of a fourth embodiment of the present invention using a circular wedge body;

FIGS. 3*b* and 3*b*' are, respectively, elevational and plan views of the base used in the fourth embodiment shown in FIGS. 3*a* and 3*a*';

FIGS. 3*c* and 3*c*' are, respectively, elevational and plan views of the wedge body used in the fourth embodiment;

FIG. 3*d* is an elevational view of the screw used in the fourth embodiment;

FIGS. 4*a* and 4*a*' are, respectively, elevational and plan views of a fifth embodiment of the present invention in the form of a double wedge body arrangement;

FIGS. 4*b* and 4*b*' are, respectively, elevational and top plan views of the first wedge in the form of a shim used in the fifth embodiment shown in FIGS. 4*a* and 4*a*';

FIGS. 4*c* and 4*c*' are, respectively, elevational and top plan views of the second wedge body used in the fifth embodiment of the present invention.

DESCRIPTION OF THE DRAWINGS

The several embodiments of the present invention herein below discussed are based upon the recognition that a wedge force will provide a superior fastening of the electrical lead to a deteriorated compressor terminal. That is, the wedge force, when applied to a remaining deteriorated portion of the terminal, forces the terminal against one or more interior sides of the terminal adapter.

In one embodiment of the present invention, the electrical lead may be fastened to the adapter by crimping or the like or, may be threaded through a hole and pinched into place thereat by the same wedge force which is used to secure the adapter to the terminal. In the latter version, the adapter does not have to be made of a highly conductive material because direct contact exists between the terminal and the lead.

Figure 1A:
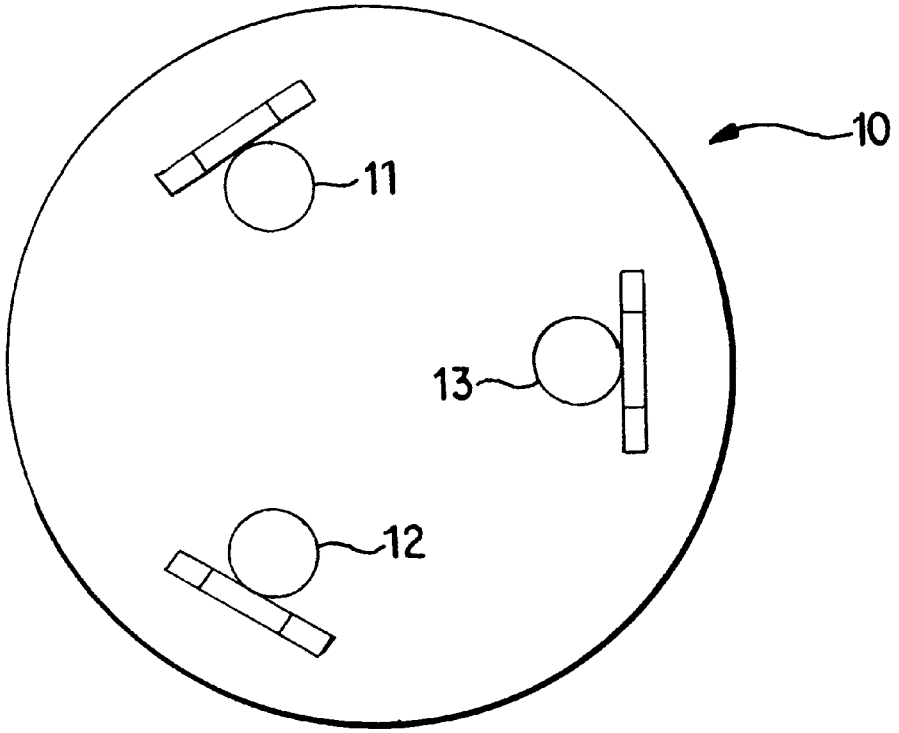
FIG. 1a PRIOR ART
Figures 1*a* and 1*b* are, respectively, a top view of the above-discussed conventional compressor terminal configuration with three known spade-connector terminals and a perspective, isolated view of one such known spade-connector terminal.
Figure 1B:
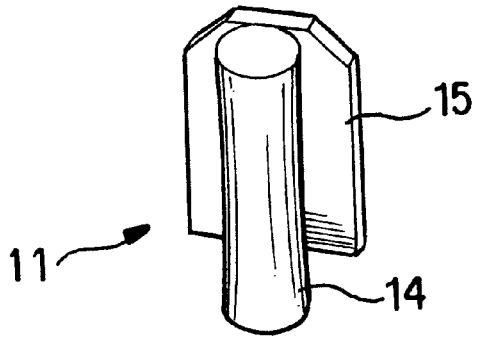
FIG. 1b PRIOR ART
Figure 2A:
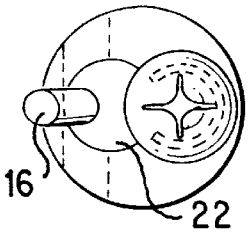
FIGS. 2*a* and 2*a*' are, respectively, elevational and plan views of one embodiment of a wedging arrangement in accordance with the present invention in which the lead wire comes into the top of the body.
Figure 2B:
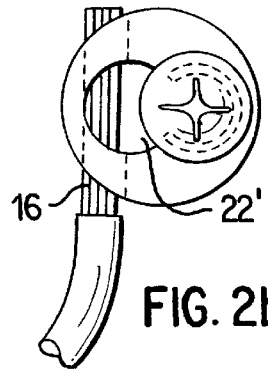
FIGS. 2*b* and 2*b*' are, respectively, elevational and plan views of a second embodiment of the present invention in which the lead wire comes into the side of the body.
Figure 2A:
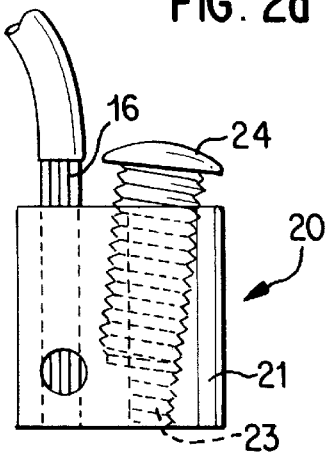
Figure 2B:
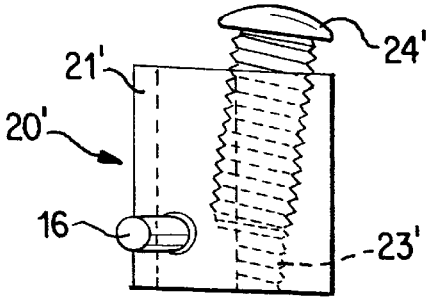
Figure 2C:
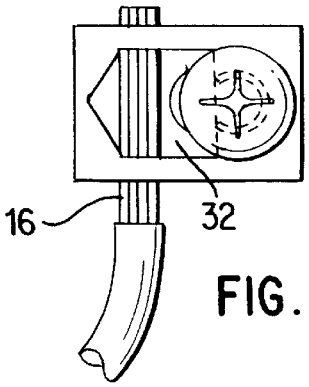
FIGS. 2*c* and 2*c*' are, respectively, elevational and plan views of a third embodiment of the present invention similar to the second embodiment but in which the body is non-cylindrical.
Figure 2D:
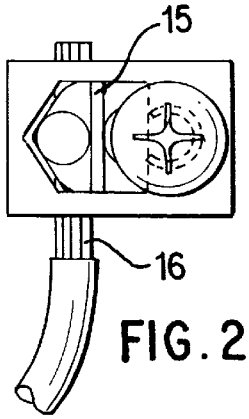
FIGS. 2*d* and 2*d*' are, respectively, elevational and plan views of the third embodiment showing the insertion of the terminal and the crimping of the lead.
Figure 2C:
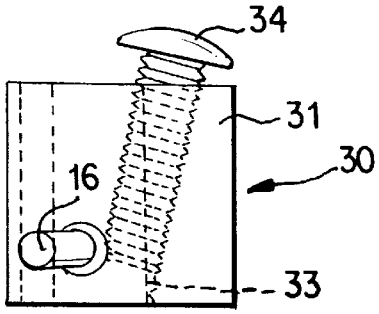
Figure 2D:
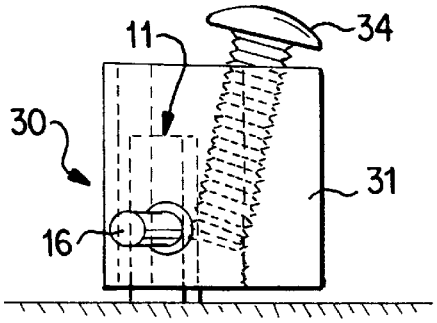

Referring specifically now to FIGS. 2*a* and 2*a*' as well as FIGS. 2*b* and 2*b*', the adapter 20, 20' can have a cylindrical main body 21, 21' or, in the adapter 30 of FIGS. 2*c* and 2*c*', a rectangular body 31. In all three versions, the adapter body 21, 21', 31 is provided with a terminal aperture in the form of an interior opening 22, 22', 32 sized to permit passage of the terminal 11, 12, 13 (FIG. 2*d*) and the lead 16.

A tapped hole 23, 23', 33 enters through one end of the adapter body 21, 21', 31 at an angle of between about 10° and 30° (25° being used in the illustrated embodiment) to the terminal aperture and is threaded either fully or partially along the extent of the body 21, 21', 31. A screw 24, 24', 34 sized to mate with the tapped hole 23, 23', 33 when screwed into the adapter body engages the spade 15 on the terminal or any remaining portion of the terminal and wedges the terminal 11, 12, 13 against the interior wall of the adapter body opposite the screw 24, 24', 34. The lead wire 16 may be placed through the terminal opening at the top, FIG. 2*a*, or at the side (FIGS. 2*b* and 2*c*).

Figure 5A:
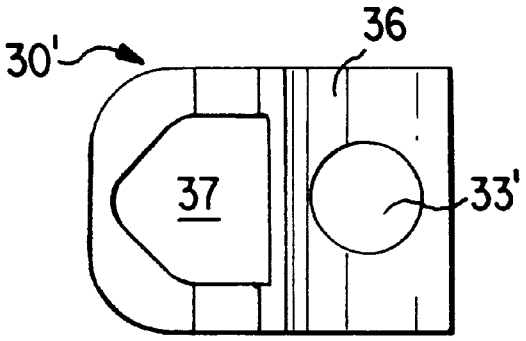
FIGS. 5*a* and 5*b* are, respectively, elevational and top plan views of a sixth and currently preferred embodiment of the present invention similar to the embodiment shown in FIGS. 2*c* and 2*c*'.
Figure 5B:
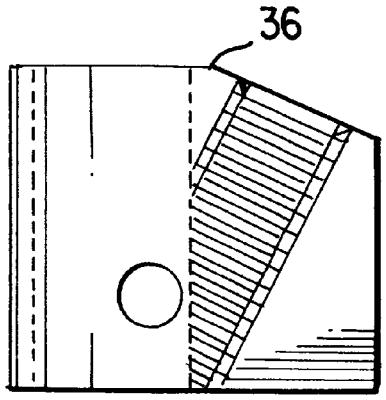

In the preferred embodiment of FIGS. 5*a* and 5*b*, the body 30' has an area 36 of added material at a chamfered portion at the top of the body between the screw hole 33' and the terminal opening 37. This arrangement allows several additional full threads to be provided. The body can be injection molded from plastic materials such as nylon, polycarbonate or other suitable electrically insulating material with sufficient strength.

Alternatively, separate wedge bodies can be used in conjunction with the adapter body as shown in the embodiments of FIGS. 3*a*–3*d* and 4*a*–4*c*'. In the former embodiment, the arrangement 40 uses a single circular wedge body 41 (FIGS. 3*c* and 3*c*'). As in the above-described embodiments, a terminal opening or hole 46 is provided in the adapter body 42, in this case of circular shape, sufficient to permit passage of the terminal 11, 12 or 13 and the associated lead 16. Likewise, a tapped and threaded hole 43 enters through one end of the body 42 but not at an angle, instead being parallel to the axis of the terminal opening 46 which is of five-sided (or pentagon) configuration or any other suitable geometric configuration. A conical wedge body 41 of circular outline (FIG. 3*c*') is used to provide the wedging action by way of a screw 44 which passes through an aperture in the wedge body 41 and is screwed into the adapter base 42. The wedge action of the conical surface 45 of the body 41 forces the terminal 11, 12 or 13 and the lead 16 against the interior wall 46' of the adapter opening 46 opposite face 45 of the wedge body 41. In the double wedge embodiment of FIGS. 4*a*, 4*a*', two wedges 51, 52 (FIGS. 4*b*, 4*b*' and FIGS. 4*c*, 4*c*', respectively) work together to provide the wedging action as seen in FIG. 4*a*.

An advantage of the present invention is that the assembly or connection operation does not require the removal of any portion of the deteriorated terminal. Another advantage is that access to the terminal adapter can be achieved from the front which is of particular advantage where there is a lack of clearance space.

In addition, the above-described embodiments provide several other advantages which are as follows:

1. The tightening force can be aligned parallel or nearly parallel to the axis of the terminal which is particularly desirable in confined terminal areas.
2. Standard tooling, such as a Phillips head screwdriver, can be used to fasten the adapter thereby avoiding the need for additional equipment.
3. A screw entering a tapped hole, either parallel to or at a small angle to the terminal, has more material available for the threads to grip than a set screw in a thin-walled conventional adapter. My approach minimizes thread stripping whereas hexagonal head set screws threaded through thin walled materials, where only one or two threads are available due to a thin-wall necessitated by space constraints, tend to strip threads because of a high driving torque created by hexagonal head tooling and a small screw stress area.
4. Forcing the lead directly against the terminal creates better contact and less electrical resistance than current designs which use the adapter body to conduct electricity. Known designs use two connection points (lead-to adapter and adapter-to-terminal) having greater electrical resistance, and this can lead to arcing and connection failure.
5. Forcing the lead directly against the terminal creates an electrical path from the terminal to the wire. Because my adapter body is configured not to be part of the electrical path, it may be fabricated from conducting as well as non-conducting material. Conventional adapters require a highly conductive material for the adapter body.
6. My invention does not require removal of any of a deteriorated terminal. This is particularly important because as little work as possible should be performed on deteriorated terminals inasmuch as further work can damage the plug which hermetically seals the compressor.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Retrofit arrangement for attaching an electrical lead to a terminal, comprising a terminal body with top and bottom ends having an aperture passing their through said top and said bottom ends and configured so as to substantially surround the terminal, and a unitary threaded wedging apparatus actuable from said top end of the terminal body and having an end thereof which directly contacts the terminal or the lead for force—lockingly and securely holding the terminal and the lead directly together.

2. The arrangement according to claim 1, wherein the threaded wedging apparatus comprises a threaded member and a mating threaded portion in the body extending at obliquely to a longitudinal axis of the terminal body, whereby relative movement between the threaded member and the threaded portion produces a wedging force of the directly contacting terminal and lead against the terminal body.

3. The arrangement according to claim 2, wherein the body is configured to have the lead enter therein through at least one of a top portion and a side wall, and the wedging apparatus is so configured as to securely hold the terminal and lead directly together without penetration into the lead.

4. The arrangement according to claim 1, wherein the body has a cylindrical outer configuration and a cylindrical opening for receiving the terminal and the lead.

5. The arrangement according to claim 1, wherein the body has a rectangular outer configuration and an opening for receiving the terminal and the lead.

6. The arrangement according to claim 5, wherein the opening is of pentagon configuration.

7. The arrangement according to claim 1, wherein the threaded wedging apparatus includes at least one wedge body and a threaded member configured to mate with a threaded portion in the terminal body, the at least one wedge body being configured to be moved toward the terminal body along a longitudinal axis thereof to produce a wedging force of the directly terminal and lead against the terminal body.

8. The arrangement according to claim 7, wherein the at least one wedging body is configured as a truncated cone with an aperture for allowing the threaded member to pass therethrough.

9. The arrangement according to claim 7, wherein the at least one wedging body comprises two members being rectangular shaped as viewed in a plan view and having mating angular surfaces in side view, with one of the members having an aperture for allowing the threaded member to pass therethrough.

10. The arrangement according to claim 1, wherein the terminal body is made of non-conductive material.

11. The arrangement according to claim 10, wherein the threaded wedging apparatus comprises a threaded member and a mating threaded portion in the body extending at obliquely to a longitudinal axis of the terminal body, whereby relative movement between the threaded member and the threaded portion produces a wedging force of the directly contacting terminal and lead against the terminal body.

12. The arrangement according to claim 10, wherein the body has a rectangular outer configuration and an opening for receiving the terminal and the lead.

13. The arrangement according to claim 12, wherein the opening is of pentagon configuration.

14. The arrangement according to claim 12, wherein the threaded wedging apparatus comprises a threaded member and a mating threaded portion in the body extending at obliquely to a longitudinal axis of the terminal body, whereby relative movement between the threaded member and the threaded portion produces a wedging force of the directly contacting terminal and lead against the terminal body.

15. The arrangement according to claim 14, wherein the terminal body has flat outer surfaces.

16. The arrangement according to claim 1, wherein the terminal body has flat outer surfaces.

17. The arrangement according to claim 16, wherein the terminal body is made of non-conductive material.

18. The arrangement according to claim 17, wherein the threaded wedging apparatus comprises a threaded member and a mating threaded portion in the body extending at obliquely to a longitudinal axis of the terminal body, whereby relative movement between the threaded member and the threaded portion produces a wedging force of the directly contacting terminal and lead against the terminal body.

19. A method of using a retrofit arrangement for attaching an electrical lead to a terminal, comprising the steps of placing in an aperture extending through top and bottom ends of a terminal body so as to surround substantially the terminal, inserting the lead into the aperture in the terminal body so as to position the terminal and the lead for direct contact therebetween within the aperture, and from the top end of the terminal body applying a wedge force obliquely to a longitudinal axis of the aperture from a bottom edge of a unitary threaded wedging member for force—lockingly and securely holding the terminal and the lead directly together.

20. The method according to claim 10, wherein the wedging force is applied at a top surface of the arrangement.

* * * * *